US008902110B2

(12) United States Patent
Hong et al.

(10) Patent No.: US 8,902,110 B2
(45) Date of Patent: Dec. 2, 2014

(54) ALL-METAL CASING STRUCTURE AND ANTENNA STRUCTURE

(75) Inventors: Yan-Ming Hong, Hsinchu (TW); Chih-Wei Chen, Miaoli County (TW); Chih-Ming Su, Taipei (TW); Sheng-Chi Chen, Miaoli County (TW)

(73) Assignee: Inpaq Technology Co., Ltd., Miaoli County (TW)

( * ) Notice: Subject to any disclaimer, the term of this patent is extended or adjusted under 35 U.S.C. 154(b) by 327 days.

(21) Appl. No.: 13/547,121

(22) Filed: Jul. 12, 2012

(65) Prior Publication Data

US 2014/0015727 A1 Jan. 16, 2014

(51) Int. Cl.
*H01Q 1/24* (2006.01)
*H01Q 1/22* (2006.01)

(52) U.S. Cl.
CPC ..... *H01Q 1/2266* (2013.01)
USPC ..... 343/702; 343/872

(58) Field of Classification Search
CPC ..... H01Q 1/2266
USPC ..... 343/702, 872
See application file for complete search history.

(56) References Cited

U.S. PATENT DOCUMENTS 6,791,499 B2 * 9/2004 Nakamura et al. ..... 343/702
8,773,321 B2 * 7/2014 Konishi ..... 343/789
2006/0244663 A1 * 11/2006 Fleck et al. ..... 343/700 MS

* cited by examiner

*Primary Examiner* — Robert Karacsony
(74) *Attorney, Agent, or Firm* — Li & Cai Intellectual Property (USA) Office

(57) ABSTRACT

An all-metal casing structure includes a casing unit, a first substrate unit, a second substrate unit, an antenna unit and a conductive unit. The casing unit includes at least one metal casing having at least one through opening. The first substrate unit includes at least one first substrate body disposed in the metal casing and neighboring to the through opening. The second substrate unit includes at least one second substrate body disposed in the metal casing and neighboring to the first substrate body. The antenna unit includes at least one antenna module disposed on the first substrate body and corresponding to the through opening, and the antenna module is electrically connected to the second substrate body. The conductive unit includes at least two conductive elements separated from each other by a predetermined distance and electrically connected between the metal casing and the first substrate body.

19 Claims, 4 Drawing Sheets

ALL-METAL CASING STRUCTURE AND ANTENNA STRUCTURE

BACKGROUND OF THE INVENTION

1. Field of the Invention

The instant disclosure relates to an all-metal casing structure and an antenna structure, and more particularly to an all-metal casing structure having an antenna function and an antenna structure disposed in a casing unit.

2. Description of Related Art

With the development of wireless communication technology, recently, the wireless communication technology has been widely applied in various fields, such as video program, wireless communication, and satellite positioning. In order to cater to the requirement of the electronic device, the signal transceiver circuit is reduced gradually, and is integrated in the electronic device, so as to improve the using convenience. However, with the requirement that the wireless communication functions (e.g. mobile communication function, global satellite positioning function, wireless network function, or digital broadcasting function etc.) of the electronic device become increasingly diversified, after each signal transceiver circuit is integrated into the electronic device, it is necessary for the manufacturers of the electronic device to dispose the respective antenna in the residual space of the electronic device. The antenna is one of the important elements affecting the quality of the wireless communication, so when the volume of the electronic device increasingly develops a design trend of being short, small, light, and thin, for the manufacturers of the electronic device, it is a problem to be solved by researcher how to integrate the antenna of various signal transceiver circuits in the electronic device.

SUMMARY OF THE INVENTION

One aspect of the instant disclosure relates to an all-metal casing structure having an antenna function and an antenna structure disposed in a casing unit.

One of the embodiments of the instant disclosure provides an all-metal casing structure having an antenna function, comprising: a casing unit, a first substrate unit, a second substrate unit, an antenna unit and a conductive unit. The casing unit includes at least one first metal casing and at least one second metal casing corresponding to the at least one first metal casing and pivotally connected with the at least one first metal casing, wherein the at least one first metal casing has at least one through opening. The first substrate unit includes at least one first substrate body disposed in the at least one first metal casing and neighboring to the at least one through opening. The second substrate unit includes at least one second substrate body disposed in the at least one first metal casing and neighboring to the at least one first substrate body. The antenna unit includes at least one antenna module disposed on the at least one first substrate body and corresponding to the at least one through opening, wherein the at least one antenna module is electrically connected to the at least one second substrate body. The conductive unit includes at least two conductive elements separated from each other by a predetermined distance and electrically connected between the at least one first metal casing and the at least one first substrate body.

More precisely, the at least one first metal casing has a first front lateral portion and a first rear lateral portion corresponding to the first front lateral portion, the at least one second metal casing has a second front lateral portion and a second rear lateral portion corresponding to the second front lateral portion, the casing unit includes a pivot element connected between the first rear lateral portion of the at least one first metal casing and the second rear lateral portion of the at least one second metal casing, and the at least one through opening is formed on the first front lateral portion of the at least one first metal casing and enclosed by a shielding element.

More precisely, the at least one first metal casing has a top surface and a bottom surface corresponding to the top surface, the first front lateral portion of the at least one first metal casing has a camber surface connected between the top surface and the bottom surface of the at least one first metal casing and reduced gradually from the top surface to the bottom surface of the at least one first metal casing, and the at least one through opening passes through the camber surface.

More precisely, the at least one first metal casing has at least one convex rib disposed on the inner surface thereof and neighboring to the first front lateral portion, and the at least one first substrate body and the at least two conductive elements are disposed on the at least one convex rib.

More precisely, the at least two conductive elements are disposed on the inner surface of the at least one first metal casing, and the at least one first substrate body has two opposite end portions respectively positioned on the at least two conductive elements through at least two securing elements.

More precisely, the at least one first substrate body is disposed on the inner surface of the at least one first metal casing, and one part of each conductive element is disposed on the inner surface of the at least one first metal casing, and another part of each conductive element is positioned on an end portion of the at least one first substrate body through at least one securing element.

More precisely, the at least one antenna module includes a microwave substrate having two opposite side portions, at least two grounding portions respectively disposed on the two opposite side portions of the microwave substrate, at least two radiating portions disposed on the microwave substrate and respectively connected to the at least two grounding portions, and at least one feeding portion disposed on the microwave substrate and connected to one of the at least two radiating portions.

Another one of the embodiments of the instant disclosure provides an all-metal casing structure having an antenna function, comprising: a casing unit, a first substrate unit, a second substrate unit, an antenna unit and a conductive unit. The casing unit includes at least one metal casing, wherein the at least one metal casing has at least one through opening. The first substrate unit includes at least one first substrate body disposed in the at least one metal casing and neighboring to the at least one through opening. The second substrate unit includes at least one second substrate body disposed in the at least one metal casing and neighboring to the at least one first substrate body. The antenna unit includes at least one antenna module disposed on the at least one first substrate body and corresponding to the at least one through opening, wherein the at least one antenna module is electrically connected to the at least one second substrate body. The conductive unit includes at least two conductive elements separated from each other by a predetermined distance and electrically connected between the at least one metal casing and the at least one first substrate body.

More precisely, the at least one metal casing has a first front lateral portion and a first rear lateral portion corresponding to the first front lateral portion, and the at least one through opening is formed on the first front lateral portion of the at least one metal casing and enclosed by a shielding element.

More precisely, the at least one metal casing has a top surface and a bottom surface corresponding to the top surface, the first front lateral portion of the at least one metal casing has a camber surface connected between the top surface and the bottom surface of the at least one metal casing and reduced gradually from the top surface to the bottom surface of the at least one metal casing, and the at least one through opening passes through the camber surface.

More precisely, the at least one metal casing has at least one convex rib disposed on the inner surface thereof and neighboring to the first front lateral portion, and the at least one first substrate body and the at least two conductive elements are disposed on the at least one convex rib.

More precisely, the at least two conductive elements are disposed on the inner surface of the at least one metal casing, and the at least one first substrate body has two opposite end portions respectively positioned on the at least two conductive elements through at least two securing elements.

More precisely, the at least one first substrate body is disposed on the inner surface of the at least one metal casing, and one part of each conductive element is disposed on the inner surface of the at least one metal casing, and another part of each conductive element is positioned on an end portion of the at least one first substrate body through at least one securing element.

More precisely, the at least one antenna module includes a microwave substrate having two opposite side portions, at least two grounding portions respectively disposed on the two opposite side portions of the microwave substrate, at least two radiating portions disposed on the microwave substrate and respectively connected to the at least two grounding portions, and at least one feeding portion disposed on the microwave substrate and connected to one of the at least two radiating portions.

Yet another one of the embodiments of the instant disclosure provides an antenna structure disposed in a casing unit, the casing unit including at least one first metal casing having at least one through opening and at least one second metal casing corresponding to the at least one first metal casing and pivotally connected with the at least one first metal casing, wherein the antenna structure comprises: a first substrate unit, a second substrate unit, an antenna unit and a conductive unit. The first substrate unit includes at least one first substrate body disposed in the at least one first metal casing and neighboring to the at least one through opening. The second substrate unit includes at least one second substrate body disposed in the at least one first metal casing and neighboring to the at least one first substrate body. The antenna unit includes at least one antenna module disposed on the at least one first substrate body and corresponding to the at least one through opening, wherein the at least one antenna module is electrically connected to the at least one second substrate body. The conductive unit includes at least two conductive elements separated from each other by a predetermined distance and electrically connected between the at least one first metal casing and the at least one first substrate body.

Therefore, the antenna efficiency of the all-metal casing structure and the antenna structure can be increased due to the combination of the first substrate unit, the second substrate unit, the antenna unit and the conductive unit.

To further understand the techniques, means and effects of the instant disclosure applied for achieving the prescribed objectives, the following detailed descriptions and appended drawings are hereby referred, such that, through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

[First Embodiment]

Figure 1:
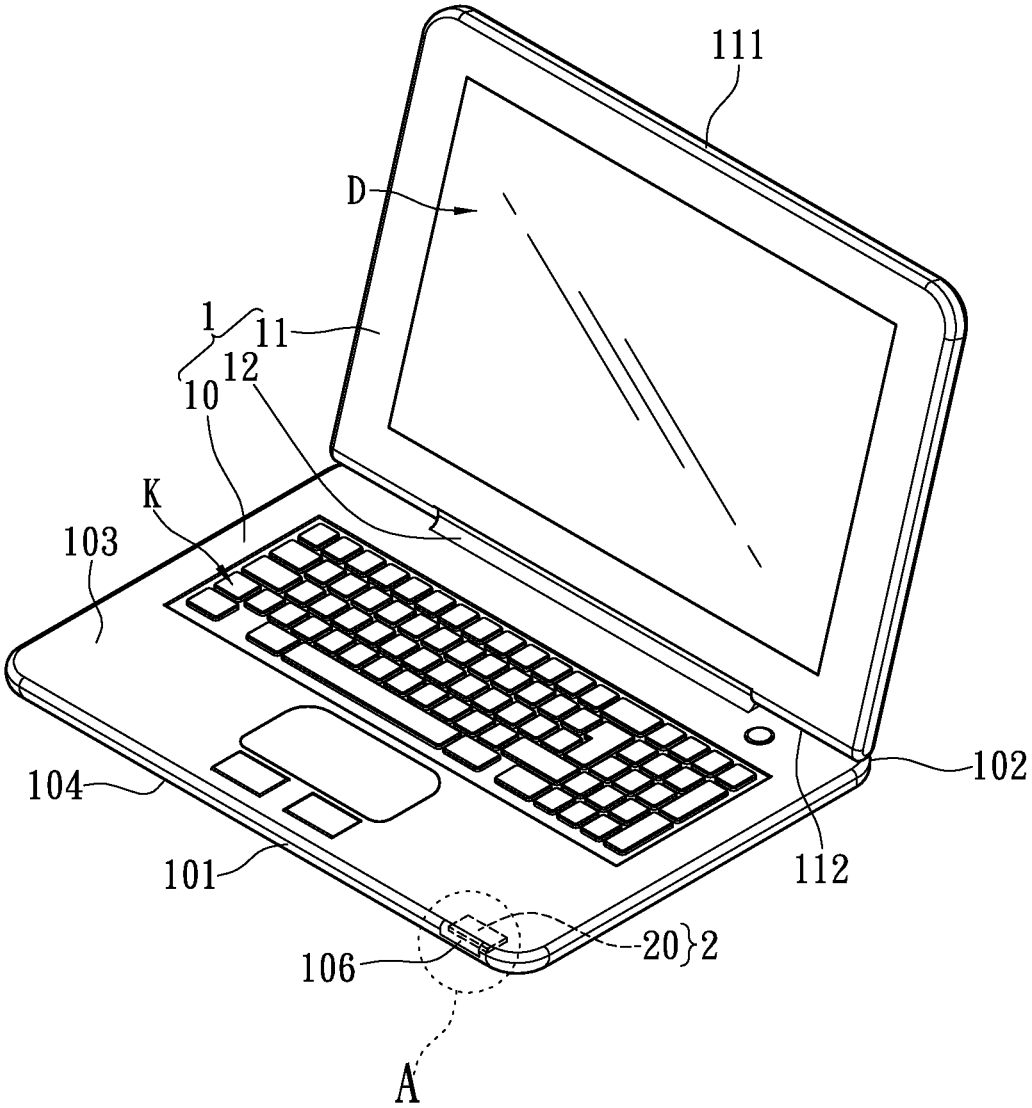
FIG. 1 shows a perspective, schematic view of the first embodiment of the instant disclosure.
Figure 2:
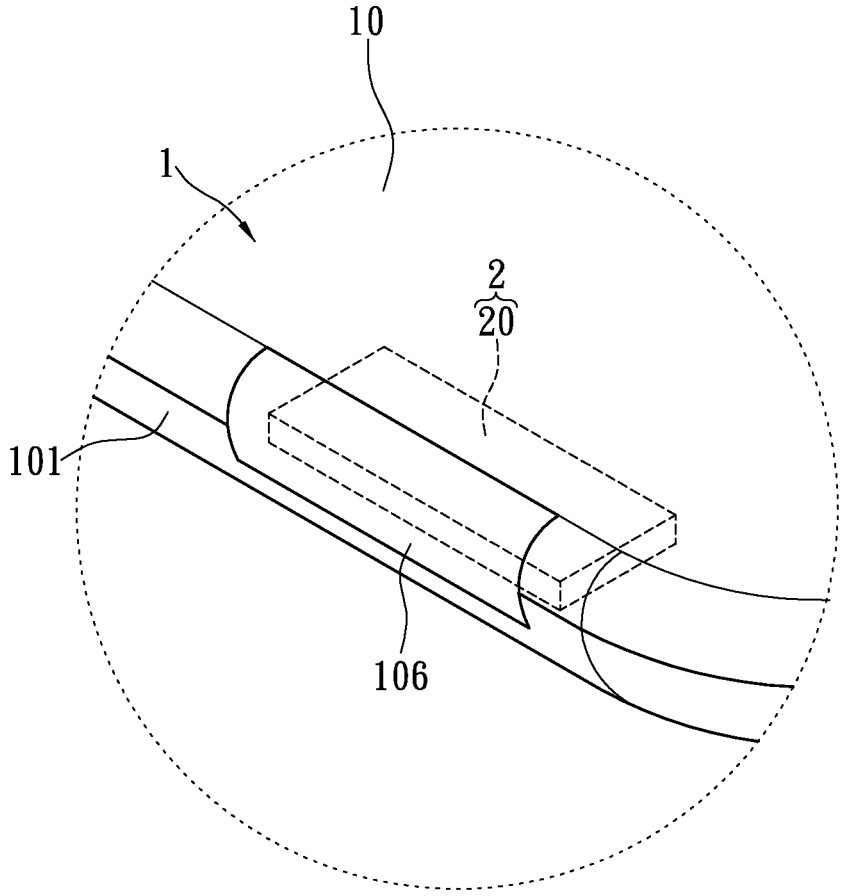
FIG. 2 shows an enlarged view taken on part A of FIG. 1.
Figure 3:
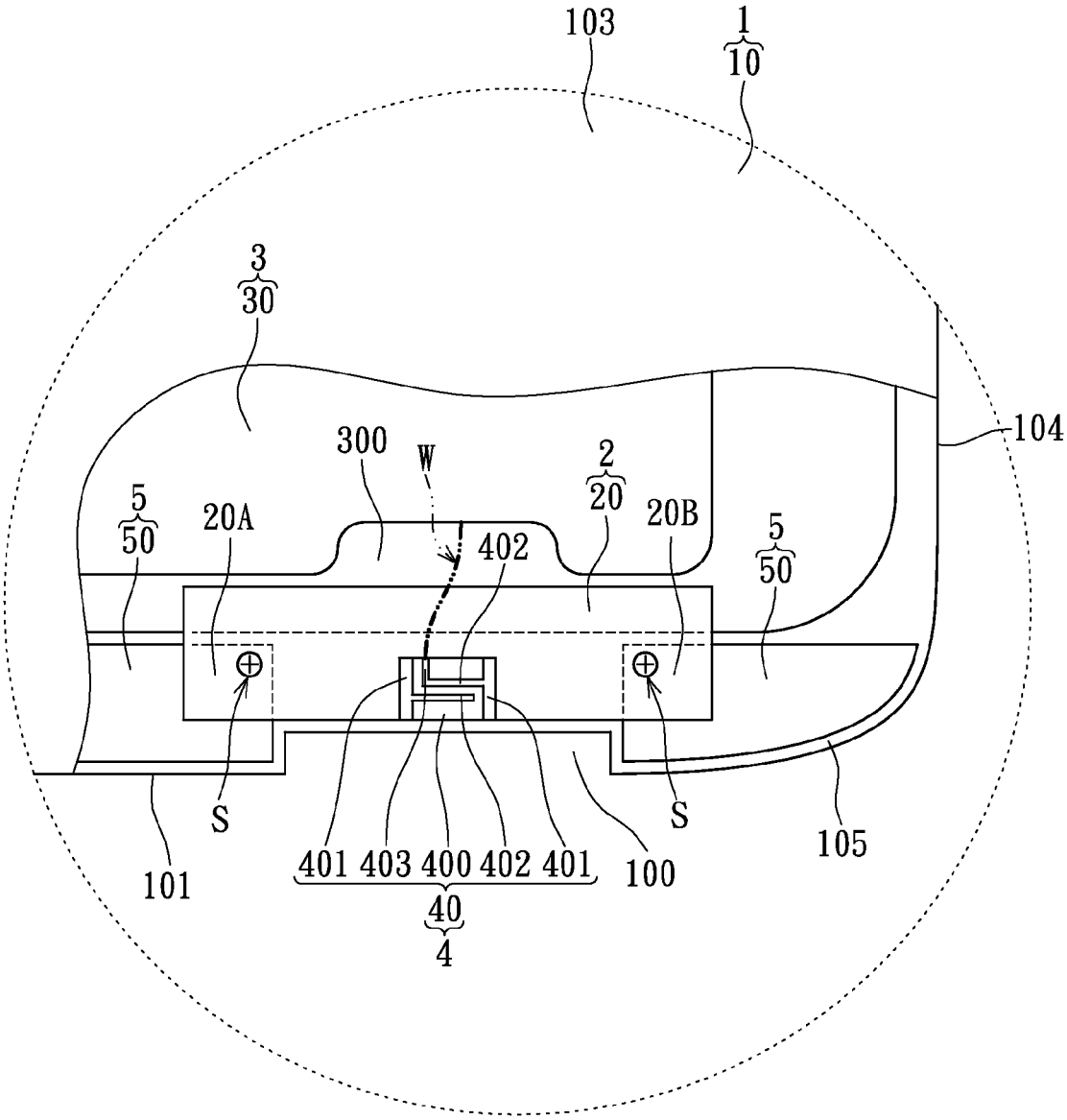
FIG. 3 shows a top, schematic taken on part A of FIG. 1 without the shielding element.

Referring to FIG. 1 to FIG. 3, where the first embodiment of the instant disclosure provides an all-metal casing structure having an antenna function, comprising: a casing unit 1, a first substrate unit 2, a second substrate unit 3, an antenna unit 4 and a conductive unit 5.

First, referring to FIG. 1, FIG. 2 and FIG. 3, the casing unit 1 includes at least one first metal casing 10 and at least one second metal casing 11 corresponding to the first metal casing 10 and pivotally connected with the first metal casing 10, where the first metal casing 10 has at least one through opening 100 (as shown in FIG. 3). For example, the first metal casing 10 may be a bottom metal casing for holding a keyboard module K of the notebook, and the second metal casing 11 may be a top metal casing for holding a display screen D of the notebook. However, the above-mentioned design for the first metal casing 10 and the second metal casing 11 of the first embodiment is merely an example and is not meant to limit the instant disclosure.

Moreover, referring to FIG. 1, FIG. 2 and FIG. 3, the first metal casing 10 has a first front lateral portion 101 and a first rear lateral portion 102 corresponding to the first front lateral portion 101, and the first metal casing 10 has a top surface 103 and a bottom surface 104 corresponding to the top surface 103. The first metal casing 10 has at least one convex rib 105 disposed on the inner surface of the first metal casing 10 and neighboring (adjacent) to the first front lateral portion 101. In addition, the second metal casing 11 has a second front lateral portion 111 and a second rear lateral portion 112 corresponding to the second front lateral portion 111. The casing unit 1 includes a pivot element 12 connected between the first rear lateral portion 102 of the first metal casing 10 and the second rear lateral portion 112 of the second metal casing 11, and the through opening 100 is formed on the first front lateral portion 101 of the first metal casing 10 and enclosed (or shielded) by a shielding element 106 (as shown in FIG. 2 and FIG. 3). For example, the first front lateral portion 101 of the first metal casing 10 has a camber surface connected between the top surface 103 and the bottom surface 104 of the first metal casing 10 and reduced gradually from the top surface 103 to the bottom surface 104 of the first metal casing 10, and the through opening 100 can pass (penetrate) through the camber surface. However, the above-mentioned design for the first metal casing 10 and the second metal casing 11 of the first embodiment is merely an example and is not meant to limit the instant disclosure.

Furthermore, referring to FIG. 1 and FIG. 3, the first substrate unit 2 includes at least one first substrate body 20 disposed in the first metal casing 10 and neighboring to the through opening 100, and the first substrate body 20 can correspond to the through opening 100. For example, the first substrate body 20 can be disposed on the inner surface of the first metal casing 10 and disposed on the convex rib 105. In addition, the second substrate unit 3 includes at least one second substrate body 30 disposed in the first metal casing 10 and neighboring to the first substrate body 20. For example, the second substrate body 30 can be disposed on the inner surface of the first metal casing 10, and the second substrate body 30 has a notch 300 facing the antenna unit 4. However, the above-mentioned design for the first substrate body 20 and the second substrate body 30 of the first embodiment is merely an example and is not meant to limit the instant disclosure.

Moreover, referring to FIG. 1 and FIG. 3, the antenna unit 4 includes at least one antenna module 40 disposed on the first substrate body 10 and corresponding to the through opening 100, where the antenna module 40 is very close to the through opening 100, and the antenna module 40 can be electrically connected to the second substrate body 30 through a conductive wire W (shown as the imaginary line between the second substrate body 30 and the antenna module 40 in FIG. 3). For example, the antenna module 40 may be a chip antenna, where the antenna module 40 includes a microwave substrate 400 having two opposite side portions, at least two grounding portions 401 respectively disposed on the two opposite side portions of the microwave substrate 400, at least two radiating portions 402 disposed on the microwave substrate 400 and respectively connected to the two grounding portions 401, and at least one feeding portion 403 disposed on the microwave substrate 400 and connected to one of the two radiating portions 402, and the feeding portion 403 of the antenna module 40 can be electrically connected to the second substrate body 30 through the conductive wire W. However, the above-mentioned design for the antenna module 40 of the first embodiment is merely an example and is not meant to limit the instant disclosure.

In addition, referring to FIG. 3, the conductive unit 5 includes at least two conductive elements 50 separated from each other by a predetermined distance and electrically connected between the first metal casing 10 and the first substrate body 20. The two conductive elements 50 can be disposed on the inner surface of the first metal casing 10, and the two conductive elements 50 can be disposed on the convex rib 105. For example, each conductive element 50 may be a copper foil attached to the inner surface of the first metal casing 10 and positioned on the convex rib 105. The first substrate body 20 has two opposite end portions (such as a first end portion 20A and a second end portion 20B) respectively positioned on the two conductive elements 50 through at least two securing elements S (such as screws). In other words, after the two conductive elements 50 are attached to the inner surface of the first metal casing 10, the first end portion 20A and the second end portion 20B of the first substrate body 20 can be respectively placed on the two conductive elements 50. Thus, not only the two conductive elements 50 can be secured on the inner surface of the first metal casing 10 through the two securing elements S, but also the first end portion 20A and the second end portion 20B of the first substrate body 20 can be respectively secured on the two conductive elements 50 through the two securing elements S. However, the above-mentioned design for the two conductive elements 50 of the first embodiment is merely an example and is not meant to limit the instant disclosure.

[Second Embodiment]

Figure 4:
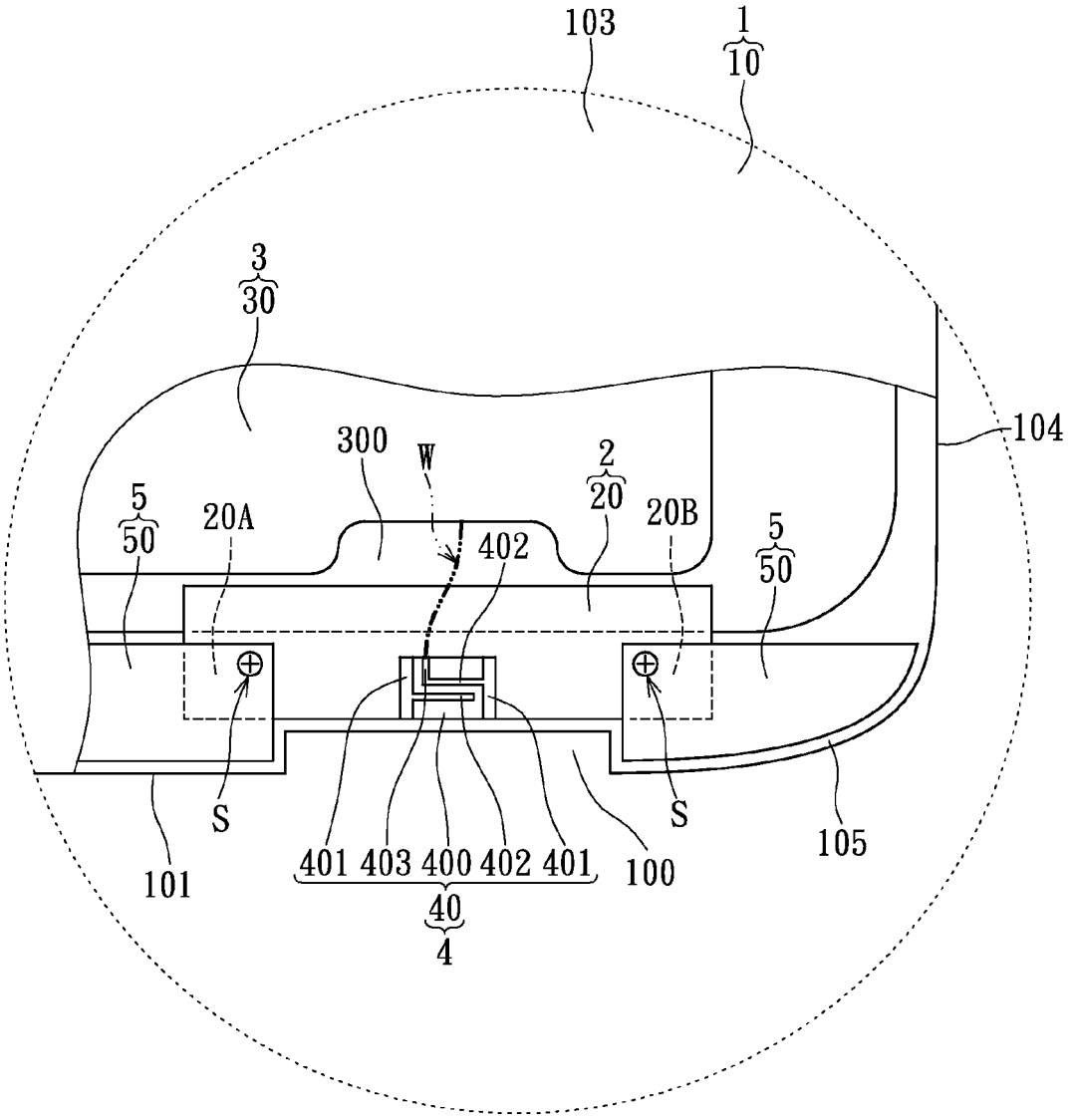
FIG. 4 shows a top, schematic view of the second embodiment of the instant disclosure without the shielding element.

Referring to FIG. 4, where the second embodiment of the instant disclosure provides an all-metal casing structure having an antenna function, comprising: a casing unit 1, a first substrate unit 2, a second substrate unit 3, an antenna unit 4 and a conductive unit 5. Comparing FIG. 4 with FIG. 3, the difference between the second embodiment and the first embodiment is as follows: in the second embodiment, the first substrate body 20 is disposed on the inner surface of the first metal casing 10, and one part of each conductive element 50 is disposed on the inner surface of the first metal casing 10 and another part of each conductive element 50 is positioned on an end portion of the first substrate body 20 through at least one securing element S. In other words, the first substrate body 20 can be disposed on the inner surface of the first metal casing 10 in advance, and then one part of each conductive element 50 is attached to the inner surface of the first metal casing 10 and another part of each conductive element 50 is attached to the first end portion 20A (or the second end portion 20B) of the first substrate body 20. Finally, the two conductive elements 50 can be secured on the first end portion 20A and the second end portion 20B through the two securing elements S, respectively.

Of course, the instant disclosure can omit the second metal casing 11 from the casing unit 1. For example, the instant disclosure can provide an all-metal casing structure having an antenna function, comprising: a casing unit 1, a first substrate unit 2, a second substrate unit 3, an antenna unit 4 and a conductive unit 5. The casing unit 1 includes at least one metal casing 10, where the metal casing 10 is the same to the first metal casing 10 shown in the first and the second embodiment, and the metal casing 10 has at least one through opening 100. The first substrate unit 2 includes at least one first substrate body 20 disposed in the metal casing 10 and neighboring to the through opening 100. The second substrate unit 3 includes at least one second substrate body 30 disposed in the metal casing 10 and neighboring to the first substrate body 20. The antenna unit 4 includes at least one antenna module 40 disposed on the first substrate body 20 and corresponding to the through opening 100, where the antenna module 40 is electrically connected to the second substrate body 30. The conductive unit 5 includes at least two conductive elements 50 separated from each other by a predetermined distance and electrically connected between the metal casing 10 and the first substrate body 20.

Furthermore, the instant disclosure can provides an antenna structure disposed in a casing unit 1 of any type of portable electronic device. For example, the casing unit 1 includes at least one first metal casing 10 having at least one through opening 100 and at least one second metal casing 11 corresponding to the first metal casing 10 and pivotally connected with the first metal casing 10. In addition, the antenna structure comprises: a first substrate unit 2, a second substrate unit 3, an antenna unit 4 and a conductive unit 5. The first substrate unit 2 includes at least one first substrate body 20 disposed in the first metal casing 10 and neighboring to the through opening 100. The second substrate unit 3 includes at least one second substrate body 30 disposed in the first metal casing 10 and neighboring to the first substrate body 20. The antenna unit 4 includes at least one antenna module 40 disposed on the first substrate body 20 and corresponding to the through opening 100, where the antenna module 40 is electrically connected to the second substrate body 30. The conductive unit 5 includes at least two conductive elements 50 separated from each other by a predetermined distance and electrically connected between the first metal casing 10 and the first substrate body 20.

In conclusion, the antenna efficiency of the all-metal casing structure and the antenna structure can be increased due to the combination of the first substrate unit 2, the second substrate unit 3, the antenna unit 4 and the conductive unit 5.

The above-mentioned descriptions merely represent the preferred embodiments of the instant disclosure, without any intention or ability to limit the scope of the instant disclosure which is fully described only within the following claims.

Various equivalent changes, alterations or modifications based on the claims of instant disclosure are all, consequently, viewed as being embraced by the scope of the instant disclosure.

What is claimed is:

1. An all-metal casing structure having an antenna function, comprising:

a casing unit including at least one first metal casing and at least one second metal casing corresponding to the at least one first metal casing and pivotally connected with the at least one first metal casing, wherein the at least one first metal casing has at least one through opening;

a first substrate unit including at least one first substrate body disposed in the at least one first metal casing and neighboring to the at least one through opening;

a second substrate unit including at least one second substrate body disposed in the at least one first metal casing and neighboring to the at least one first substrate body;

an antenna unit including at least one antenna module disposed on the at least one first substrate body and corresponding to the at least one through opening, wherein the at least one antenna module is electrically connected to the at least one second substrate body; and a conductive unit including at least two conductive elements separated from each other by a predetermined distance and electrically connected between the at least one first metal casing and the at least one first substrate body.

2. The all-metal casing structure of claim 1, wherein the at least one first metal casing has a first front lateral portion and a first rear lateral portion corresponding to the first front lateral portion, the at least one second metal casing has a second front lateral portion and a second rear lateral portion corresponding to the second front lateral portion, the casing unit includes a pivot element connected between the first rear lateral portion of the at least one first metal casing and the second rear lateral portion of the at least one second metal casing, and the at least one through opening is formed on the first front lateral portion of the at least one first metal casing and enclosed by a shielding element.

3. The all-metal casing structure of claim 2, wherein the at least one first metal casing has a top surface and a bottom surface corresponding to the top surface, the first front lateral portion of the at least one first metal casing has a camber surface connected between the top surface and the bottom surface of the at least one first metal casing and reduced gradually from the top surface to the bottom surface of the at least one first metal casing, and the at least one through opening passes through the camber surface.

4. The all-metal casing structure of claim 2, wherein the at least one first metal casing has at least one convex rib disposed on the inner surface thereof and neighboring to the first front lateral portion, and the at least one first substrate body and the at least two conductive elements are disposed on the at least one convex rib.

5. The all-metal casing structure of claim 1, wherein the at least two conductive elements are disposed on the inner surface of the at least one first metal casing, and the at least one first substrate body has two opposite end portions respectively positioned on the at least two conductive elements through at least two securing elements.

6. The all-metal casing structure of claim 1, wherein the at least one first substrate body is disposed on the inner surface of the at least one first metal casing, and one part of each conductive element is disposed on the inner surface of the at least one first metal casing, and another part of each conductive element is positioned on an end portion of the at least one first substrate body through at least one securing element.

7. The all-metal casing structure of claim 1, wherein the at least one antenna module includes a microwave substrate having two opposite side portions, at least two grounding portions respectively disposed on the two opposite side portions of the microwave substrate, at least two radiating portions disposed on the microwave substrate and respectively connected to the at least two grounding portions, and at least one feeding portion disposed on the microwave substrate and connected to one of the at least two radiating portions.

8. An all-metal casing structure having an antenna function, comprising:

a casing unit including at least one metal casing, wherein the at least one metal casing has at least one through opening;

a first substrate unit including at least one first substrate body disposed in the at least one metal casing and neighboring to the at least one through opening;

a second substrate unit including at least one second substrate body disposed in the at least one metal casing and neighboring to the at least one first substrate body;

an antenna unit including at least one antenna module disposed on the at least one first substrate body and corresponding to the at least one through opening, wherein the at least one antenna module is electrically connected to the at least one second substrate body; and a conductive unit including at least two conductive elements separated from each other by a predetermined distance and electrically connected between the at least one metal casing and the at least one first substrate body.

9. The all-metal casing structure of claim 8, wherein the at least one metal casing has a first front lateral portion and a first rear lateral portion corresponding to the first front lateral portion, and the at least one through opening is formed on the first front lateral portion of the at least one metal casing and enclosed by a shielding element.

10. The all-metal casing structure of claim 9, wherein the at least one metal casing has a top surface and a bottom surface corresponding to the top surface, the first front lateral portion of the at least one metal casing has a camber surface connected between the top surface and the bottom surface of the at least one metal casing and reduced gradually from the top surface to the bottom surface of the at least one metal casing, and the at least one through opening passes through the camber surface.

11. The all-metal casing structure of claim 9, wherein the at least one metal casing has at least one convex rib disposed on the inner surface thereof and neighboring to the first front lateral portion, and the at least one first substrate body and the at least two conductive elements are disposed on the at least one convex rib.

12. The all-metal casing structure of claim 8, wherein the at least two conductive elements are disposed on the inner surface of the at least one metal casing, and the at least one first substrate body has two opposite end portions respectively positioned on the at least two conductive elements through at least two securing elements.

13. The all-metal casing structure of claim 8, wherein the at least one first substrate body is disposed on the inner surface of the at least one metal casing, and one part of each conductive element is disposed on the inner surface of the at least one metal casing, and another part of each conductive element is positioned on an end portion of the at least one first substrate body through at least one securing element.

14. The all-metal casing structure of claim 8, wherein the at least one antenna module includes a microwave substrate having two opposite side portions, at least two grounding portions respectively disposed on the two opposite side portions of the microwave substrate, at least two radiating portions disposed on the microwave substrate and respectively connected to the at least two grounding portions, and at least one feeding portion disposed on the microwave substrate and connected to one of the at least two radiating portions.

15. An antenna structure disposed in a casing unit, the casing unit including at least one first metal casing having at least one through opening and at least one second metal casing corresponding to the at least one first metal casing and pivotally connected with the at least one first metal casing, wherein the antenna structure comprises:

a first substrate unit including at least one first substrate body disposed in the at least one first metal casing and neighboring to the at least one through opening;

a second substrate unit including at least one second substrate body disposed in the at least one first metal casing and neighboring to the at least one first substrate body;

an antenna unit including at least one antenna module disposed on the at least one first substrate body and corresponding to the at least one through opening, wherein the at least one antenna module is electrically connected to the at least one second substrate body; and a conductive unit including at least two conductive elements separated from each other by a predetermined distance and electrically connected between the at least one first metal casing and the at least one first substrate body.

16. The antenna structure of claim 15, wherein the at least one first metal casing has a first front lateral portion and a first rear lateral portion corresponding to the first front lateral portion, the at least one first metal casing has at least one convex rib disposed on the inner surface thereof and neighboring to the first front lateral portion, and the at least one first substrate body and the at least two conductive elements are disposed on the at least one convex rib.

17. The antenna structure of claim 15, wherein the at least two conductive elements are disposed on the inner surface of the at least one first metal casing, and the at least one first substrate body has two opposite end portions respectively positioned on the at least two conductive elements through at least two securing elements.

18. The antenna structure of claim 15, wherein the at least one first substrate body is disposed on the inner surface of the at least one first metal casing, and one part of each conductive element is disposed on the inner surface of the at least one first metal casing, and another part of each conductive element is positioned on an end portion of the at least one first substrate body through at least one securing element.

19. The antenna structure of claim 15, wherein the at least one antenna module includes a microwave substrate having two opposite side portions, at least two grounding portions respectively disposed on the two opposite side portions of the microwave substrate, at least two radiating portions disposed on the microwave substrate and respectively connected to the at least two grounding portions, and at least one feeding portion disposed on the microwave substrate and connected to one of the at least two radiating portions.

* * * * *